United States Patent [19]

Stark

[11] 4,381,643

[45] May 3, 1983

[54] DIESEL EXHAUST CLEANER AND BURNER SYSTEM WITH CONSTANT BURNER AIR MIXTURE SUPPLY

[75] Inventor: Terrence L. Stark, Washington, Mich.

[73] Assignee: General Motors Corporation, Detroit, Mich.

[21] Appl. No.: 289,246

[22] Filed: Aug. 3, 1981

[51] Int. Cl.[3] ..... F01N 3/02

[52] U.S. Cl. ..... 60/303; 60/311; 60/296

[58] Field of Search ..... 60/303, 311, 286, 284, 60/296

[56] References Cited

U.S. PATENT DOCUMENTS

| | | | |
|---|---|---|---|
| 4,167,852 | 9/1979 | Ludecke | 60/296 |
| 4,211,075 | 7/1980 | Ludecke | 60/288 |
| 4,217,757 | 8/1980 | Crone, Jr. | 60/288 |
| 4,281,512 | 8/1981 | Mills | 55/283 |
| 4,335,574 | 6/1982 | Sato | 60/311 |

FOREIGN PATENT DOCUMENTS 2040182 8/1980 United Kingdom .

*Primary Examiner*—Douglas Hart
*Attorney, Agent, or Firm*—Arthur N. Krein

[57] ABSTRACT

An exhaust cleaner and burner system for diesel engines provides for the trapping of particulates in the engine exhaust gases by their passage through a filter element. Collected particulates on the filter element are incinerated by the use of a heater means with the necessary air required for combustion of the particulates being drawn through the filter element by engine vacuum in the intake manifold of the engine. By throttling the air flow into the intake manifold so as to maintain a substantially constant depression therein, the required fuel burner mixture air flow needed for the combustion of carbonaceous particulates collected on a filter element is obtained during engine operation.

4 Claims, 2 Drawing Figures

DIESEL EXHAUST CLEANER AND BURNER SYSTEM WITH CONSTANT BURNER AIR MIXTURE SUPPLY

BACKGROUND OF THE INVENTION

This invention relates to diesel engines exhaust treatment systems, and, in particular, to an exhaust cleaner and burner system for collecting and then incinerating particulates discharged in the exhaust gases from a diesel engine.

DESCRIPTION OF THE PRIOR ART

It is known in the art to provide a diesel engine with an exhaust treatment system that includes one or more particulate traps or filters that are operative to filter out and collect particulates from the exhaust gas stream discharged from the engine. Such particulates consists largely of carbon particles that tend to plug the filter, thus restricting exhaust gas flow therethrough. Accordingly, after continued use of such a system for a period of time dependent on engine operation, it becomes desirable to effect regeneration of the particulate filter.

Restoration of such a particulate filter has been accomplished by the use of a suitable auxiliary burner device. For example, an air-fuel nozzle and an ignition device can be used and operated, when desired, to heat the exhaust gases and the particulate filter to the combustion temperature of the collected particulates so as to burn them off the filter surfaces and, accordingly, to thus reopen the flow paths therethrough to again permit normal flow of the exhaust gases through that filter. Alternatively, an electric heater means can be used to generate the additional heat required to initiate the combustion of the trapped particulates.

However, during the incineration of accumulated particulates on a filter, the uncontrolled burning thereof can result in excessively high temperatures. Such high temperatures, if not evenly distributed throughout the body of the filter, can result in thermal gradients which may cause mechanical failure of the filter structure or, even worse, such high temperatures may actually exceed the melting temperatures of the material used to fabricate the filter.

SUMMARY OF THE INVENTION

Accordingly, a primary object of the invention is to provide an improved exhaust cleaner and burner system for use with a diesel engine that advantageously utilizes valve controlled passage means and a constant engine manifold depression whereby air can be drawn at a controlled rate to an inactive filter to effect the controlled incineration of particulates collected thereon.

Another object of the invention is to provide an improved exhaust cleaner and burner system for a diesel engine of the type having a throttle means providing a constant depression in the intake manifold thereof, the system having valve means whereby to bypass exhaust gas from a cleaner member thereof so that the filter associated with this cleaner member is then inactive so that the particulates collected thereon can be incinerated, with the air to effect combustion of the particulates being drawn through the inactive filter by the depression in the intake manifold.

For a better understanding of the invention, as well as other objects and further features thereof, reference is had to the following detailed description of the invention to be read in connection with the accompanying drawings.

DESCRIPTION OF THE FIRST EMBODIMENT

Figure 1:
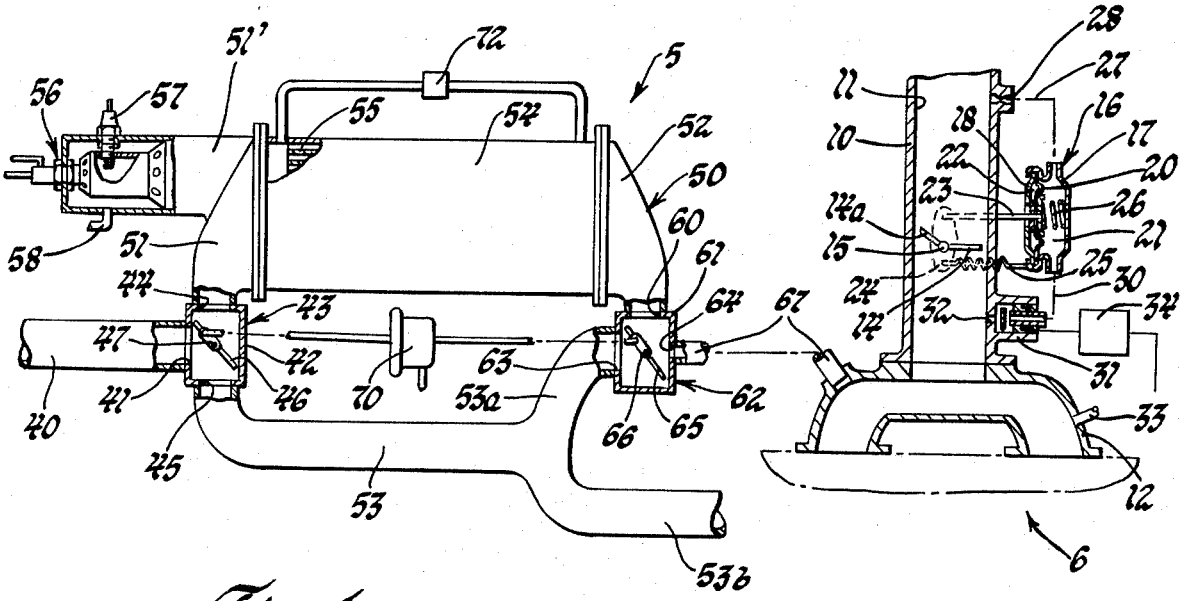
FIG. 1 is a schematic view of a first embodiment of a diesel exhaust cleaner and burner system with constant burner air mixture supply, in accordance with the invention, associated with a diesel engine, with parts broken away to show various details of the system and engine; and, FIG. 2 is a schematic view of an alternate embodiment of a dual element diesel exhaust cleaner and burner system with constant burner mixture air supply constructed in accordance with the invention.

Referring first to FIG. 1, there is illustrated a single path with exhaust bypass embodiment of the exhaust cleaner and burner system, generally designated 5, in accordance with the invention, that is used with a diesel engine 6 having an air induction system including a throttle body 10 having an induction passage 11 therethrough for supplying air via an intake manifold 12 to the cylinders, not shown, of the engine.

In order to provide a constant depression in the intake manifold 12, air flow through the induction passage 11 is controlled by means of a throttle valve 14 fixed to a throttle shaft 15 which is suitably journaled for pivotal movement in the throttle body 10. As shown, the throttle shaft 15 is positioned for pivotal movement at right angles to the axis of the induction passage but offset to one side of the central axis of this passage.

Pivotal movement of the throttle shaft 15 is effected by means of a suitable intake manifold constant depression throttle controller. In the conventional embodiment illustrated, this controller includes a suitable actuator motor, such as the differential pressure actuated motor 16.

Motor 16 includes a two-piece housing consisting of cup-shaped, base 17 and cover 18 suitably secured together with a diaphragm 20 sandwiched therebetween. Diaphragm 20 defines with base 17 a chamber 21 and with cover 18 an atmospheric chamber 22, the latter being in direct communication with the atmosphere.

An actuator rod 23 has one end thereof suitably fixed to diaphragm 20 so as to slidably extend through the cover 18 with its opposite end then pivotably secured to one end of a lever 24. Lever 24, intermediate its ends is fixed to throttle shaft 15 and, at its opposite end this lever is fixed to the free end of a throttle return spring 25 that is operatively positioned to normally bias the throttle valve 14 in a valve closing direction. Also as shown, a second spring 26 is located in chamber 21 and is operatively positioned to also aid in biasing the throttle valve 14 toward the closed position. In addition, in order to reduce the closing torque output required of the motor 16, the throttle valve 14 is provided with an upstanding wing portion **14*a*** on the upstream face end thereof.

As will now be apparent, one surface of the diaphragm 20 is subjected to the atmospheric pressure in chamber 22 while its opposite surface is exposed to the variable controlled pressure in chamber 21. For this purpose, chamber 21 is operatively connected via a passage 27, with a flow orifice port 28, of predetermined flow area, opening into the induction passage 11 upstream of throttle valve 14. In addition, chamber 21 is also operatively connected, via a passage 30 and solenoid valve 31, to a vacuum port 32 located in the throttle body for communication with the induction passage 11 downstream of the throttle valve 14.

The solenoid valve 31, controlling flow between chamber 21 and the vacuum port 32, is connected to a suitable source of electrical power as controlled by an onboard electronic control unit, not shown. As is well known, such an electronic control unit is adapted to receive various input signals, such as fuel rack position, engine speed, air flow, exhaust temperature and others, which input signals are processed by the electronic control unit to control various engine operations. Preferably one such input signal is provided by means of a manifold vacuum sensor 33, which signal is processed to provide an electrical signal that is converted by a suitable solenoid driver 34 to a duty cycle which operates the solenoid valve 31 whereby to, in turn, control operation of the actuator motor 16, as required, so as to maintain a preselected regulated manifold vacuum in intake manifold 12.

In operation, when actual induction air flow exceeds the desired air flow necessary to maintain a preselected desired manifold depression, the duty cycle is increased to reduce flow through solenoid valve 31 from chamber 21. Air bleed via the flow orifice port 28 into chamber 21 cause an increase in pressure on that side of the diaphragm 20, which then allows springs 25 and 26 to effect movement of the throttle valve 14 in a closing direction, reducing air flow through the induction passage 11 with a resultant increase in manifold vacuum as required to maintain a preselected, substantially constant depression in the intake manifold.

Referring now to the exhaust cleaner and burner system 5 illustrated to FIG. 1, this system includes an exhaust passage 40 that is adapted to be suitably connected at one end to the engine 6 so as to receive the flow of exhaust gas discharged therefrom. The opposite end of this exhaust passage 40 is connected to the inlet 41 in the valve housing 42 of a flow control valve 43. Valve housing 42 is also provided with first and second outlets 44 and 45, respectively, with the flow from inlet 41 to either outlet 44 or outlet 45 controlled by a valve member 46 fixed to a shaft 47 that is suitably journaled for pivotable movement in the valve housing 42.

A cleaner member 50, having an intake section 51 and a discharge section 52, has its intake section 51 connected in flow communication with the outlet 44 while an exhaust bypass duct 53 has one end thereof, the left hand end with reference to FIG. 1, connected in flow communication with the outlet 45 of valve 43. As illustrated, the bypass duct 53, at its opposite end, is of Y-shape whereby there are provided separate side branches **53*a* and 53*b* at this end of the bypass duct. The side branch 53*b*** is adapted to discharge exhaust gases directly to the atmosphere or, if desired, it can be connected to a conventional exhaust pipe and muffler, not shown.

Intermediate the intake and discharge sections 51 and 52, respectively, the cleaner member 50 is provided with a housing portion 54. This housing portion 54 is of suitable configuration whereby to support a particulate trap of filter 55 therein for flow communication with the associate intake and discharge ends at opposite ends thereof.

The particulate filter 55 may be of any material and construction suitable for use in a diesel engine exhaust system to collect particulates and other combustibles present in the stream of exhaust gas discharged from the engine and which may subsequently be heated to the combustion temperature of the particulates whereby to permit incineration of these particulates so that the filter may be regenerated. Suitable materials may include, for example, ceramic beads or monolith ceramic structures similar to those currently used as catalyst support means in exhaust catalytic converters presently used in many gasoline fueled automobile engines. Alternately, metal wire mesh or multiple screen elements may also provide suitable filter element materials for this purpose.

In the embodiment illustrated, the particulate filter 55 is a monolithic ceramic structure of honeycomb configuration so as to provide parallel channels running the length thereof. Alternate cell channel openings on the monolith face are blocked and, at the opposite end the alternate channel openings are blocked in a similar manner but displaced by one cell. With this arrangement the exhaust gas cannot flow directly through a given channel but is forced to flow through the separating porous walls into an adjacent channel. The exhaust gas is thus filtered as it flows through the porous walls between adjacent channels.

Additional heat needed to raise the temperature of the particulates trapped on the filter 55 to their combustion temperature is supplied by a suitable heater means. In the embodiment shown the heater means includes an air-fuel mixing and atomizing burner assembly 56 operatively connected to the intake passage extension 51' of the intake section 51 of the cleaner member 50. This burner assembly 56 is capable of supplying an atomized combustible air-fuel mixture to the interior of this intake section 51. A suitable electric igniter 57, such as a spark plug, as shown, or a glow plug, is also operatively mounted to the intake section 51 for igniting the air-fuel mixture supplied by the burner assembly.

Additional oxygen that is necessary in order to support combustion of the particulates on the filter 55 is supplied by means of a secondary air passage 58, with a suitable one-way valve, not shown, associated therewith that is connected for flow communication with the interior of the extension 51' of intake section 51 next adjacent to the burner assembly 56. The inlet end of the secondary air passage 58 is adapted to be connected to a source of clean air at atmospheric pressure.

Now in accordance with a feature of the invention, the discharge section 52 of cleaner member 50 is connected to the inlet 60 in the valve housing 61 of a second flow control valve 62 that is structurally similar to the previously described control valve 43. As shown, valve housing 61 is also provided with first and second outlets 63 and 64, respectively, with flow from inlet 60 to either outlet 63 or 64 controlled by a valve 65 fixed to the shaft 66 suitably journaled for pivotable movement in valve housing 61.

As shown, outlet 63 is connected to the side branch **53*a* of bypass duct 53. The other outlet 64 is connected by a suitable conduit 67 for flow communication with the interior of the intake manifold 12 of the engine 6. With this arrangement outlet 63 will be in flow communication with the low pressure induction charge downstream of the throttle valve 14, that is, to a substantially constant manifold depression, whereby secondary air can be drawn through the secondary air passage 58 at a controlled rate so as to provide for the controlled combustion of particulates previously trapped on the filter 55**.

As shown, the valve members 46 and 65 of the control valves 43 and 62, respectively, are operated by a suitable actuator, such as vacuum actuator 70. In the construction illustrated, the vacuum actuator 70 is operatively connected to the valve shafts 47 and 66 of the respective control valves 43 and 62 so as to effect the desired pivotable movement of both their respective valve members.

Preferably, and as schematically shown in FIG. 1, the vacuum actuator 70 is a conventional two-position actuator that is operative to effect movement of the associate valve members 46 and 65. The vacuum fitting of this actuator 70 is adapted to be selectively connected to a suitable source of vacuum or to the atmosphere as controlled by a solenoid valve, not shown. The solenoid valve, not shown, would be adapted to be connected to a source of electric power as controlled by means of the electronic control unit, not shown, in a manner well known in the art.

In addition to the operational control of the vacuum actuator 70, the electronic control unit can also be used to control the operation of both the burner assembly 56 and of the electric igniter 57. For this purpose, the electronic control unit would, in a conventional manner, receive input signals of various engine operating conditions as previously described and, in addition, would preferably also receive a suitable signal indicating the pressure differential existing across the particulate filter 55 during engine operation, as sensed by a suitable pressure differential gauge 72 operatively connected for communication with both the inlet and outlet sides of the particulate filter 55 whereby to measure the pressure drop across the filter.

In operation, exhaust gases from the engine 6 are discharged into the system 5 by means of the exhaust passage 40. During normal operation, the valve members 46 and 65 would be rotated 90° clockwise from their respective positions shown in FIG. 1, so that exhaust gas entering control valve 43 is directed to flow through the particulate filter 55 to be cleaned thereby and then into control valve 62. From valve 62 the cleaned exhaust is directed to flow into branch section 53*a* for discharge out through branch section 53*b*.

During the trap regeneration cycle which occurs after excessive back pressure build-up in the filter 55, both valve members 46 and 65 of valves 43 and 62 are rotated to the position shown in FIG. 1. With the valve member 46 of control valve 43 positioned as shown in FIG. 1, the exhaust gas will then be diverted into the bypass duct 53 for discharge via side branch 53*b* to the atmosphere, the valve member 46 blocking direct flow of exhaust gases to the particulate filter 55 which is now an inactive filter. With the valve member 65 of control valve 63 positioned as shown, it will block the flow of exhaust gas out through the side branch 53*a*.

It will now be apparent that when the valve member 46 is in the position shown in FIG. 1, the particulate filter 55 is, in effect, an inactive filter. Assuming that this inactive filter 55 contains carbon and other particulates previously collected, these particulates are then removed from this filter by incineration. The necessary heat to effect this incineration is obtained by means of the burner assembly 56 which supplies a combustible air-fuel mixture which is ignited by the electric igniter 57, the operation of both of these last two elements being controlled, as desired, by the electronic control unit, not shown.

Of course, with the valve member 46 thus positioned as shown in FIG. 1 to make the filter 55 an inactive filter, the valve member 65 of control valve 62 would also be in the position shown in this figure placing the discharge end 52 of the cleaner member 50 in direct flow communication, via the conduit 67, with the intake manifold 12. Thus with this arrangement, during engine operation a pressure differential would then exist across the filter 55 that is, atmospheric pressure at the inlet of secondary air passage 58 and a controlled vacuum in intake manifold 12. As a result of this differential pressure, atmospheric air would be drawn, via second air passage 58, to flow through the filter 55 and then into the intake manifold 12 to be combined into the induction charge supplied to the engine. This flow of secondary air is of course heated by the heater means to then flow through the filter 55 whereby to effect the incineration of the particulates previously trapped thereon.

It should now be apparent to those skilled in the art, that either the effective flow area of the air passage 58 or the efffective flow area of conduit 67 would be appropriately preselected for a given engine/cleaner system application so as to obtain a desired air flow through the filter to effect the controlled incineration of particulates while still permitting a preselected constant depression, that is, manifold vacuum to be maintained in the intake manifold 12 of the engine.

After a time interval sufficient to effect complete incineration of the particulates on the filter 55, as determined for example, by a preselected decrease in the pressure drop across the filter, the operation of the heating means is discontinued. Thereafter, the valve members 46 and 65 are repositioned so that the exhaust gas is then again directed to flow through the filter 55 to be cleaned thereby.

With reference to the pressure drop across the particulate filter 55, by way of an example, in a particulate engine/cleaner system application, the preselected pressure drop through a dirty filter was limited to be approximately 18" water (0.6498 psig) under a full exhaust flow condition and was 9" water (0.3249 psig) under a full exhaust flow condition through a clean filter.

Figure 2:
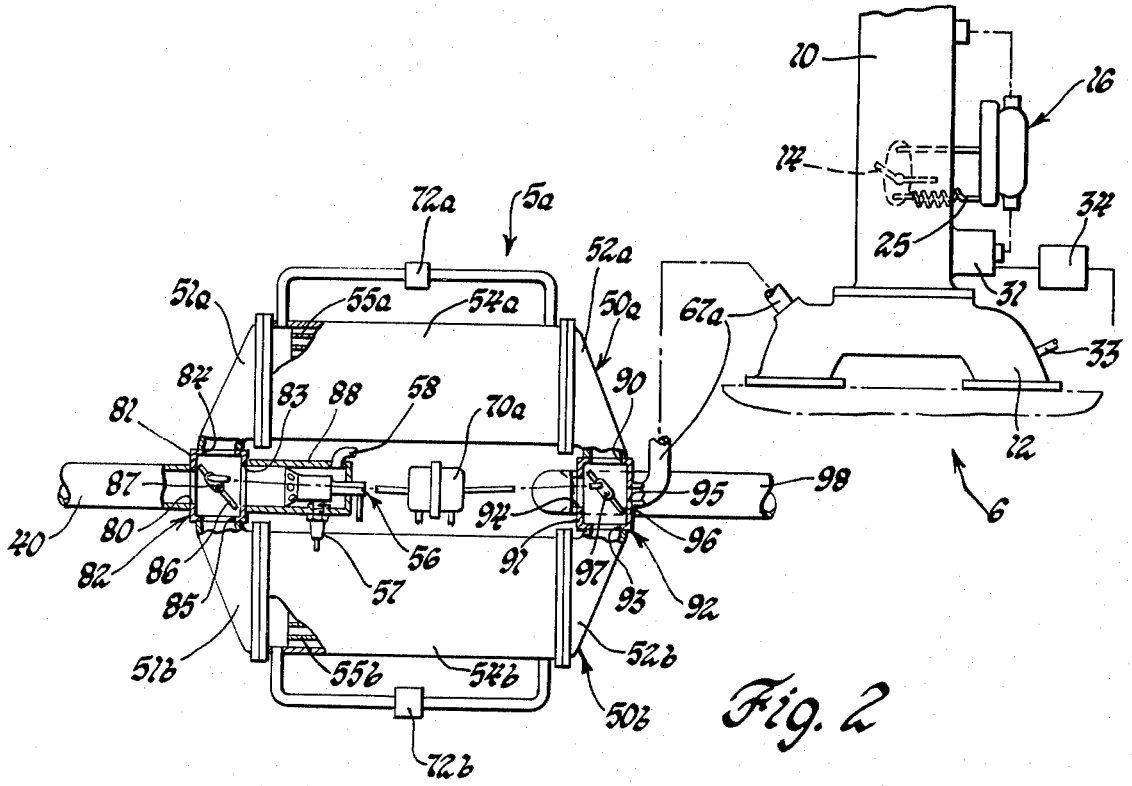

An alternate embodiment of a dual path exhaust cleaner and burner system with constant burner air mixture supply in accordance with the invention is shown in FIG. 2, wherein similar parts are designated by similar numerals with an addition of a suffix (a, b) where appropriate.

In this system 5*a*, the discharge end of the exhaust passage 40 is connected to a first inlet 80 in the valve housing 81 of a four-way control valve 82.

As shown, the housing 81 of this four-way valve also includes a second inlet 83 located opposite inlet 80 and, first and second outlets 84 and 85, respectively, that are located opposite to each other and positioned intermediate the inlets 80 and 83.

A valve member 86 is fixed in a conventional manner to a valve shaft 87 that is suitably journaled in the valve housing for pivotable movement. As shown, the valve member 86 is thus movable between a first position, the position shown in FIG. 2, for flow interconnecting the inlet 80 with the outlet 85 and the inlet 83 with the outlet 84 and, a second position interconnecting inlet 80 for flow communication with outlet 84 and for connecting inlet 83 in flow communication with outlet 85.

A pair of cleaner members 50*a* and 50*b*, each having intake and discharge sections 51*a*, 51*b* and 52*a*, 52*b*, respectively, are connected at their associate intake ends to the outlets 84 and 85, respectively, of the control valve 82. The discharge sections 52*a*, 52*b* of the cleaner member 50*a* and 50*b* are connected to the inlets 90 and 93, of a second four-way control valve 92 to be described in detail hereinafter.

Each cleaner member 50*a* and 50*b* intermediate their respective intake and discharge sections is provided with a housing portion 54*a*, and 54*b*, respectively, supporting particulate filters 55*a* and 55*b*, respectively, therein.

A secondary duct 88 has its outlet end connected to the inlet 83 of the control valve 82 and at its opposite end supports a suitable heater means such as the burner assembly 56 and the electric igniter 57. In addition, a secondary air passage 58 is operatively connected to the secondary duct 88 for supplying secondary air to effect the controlled incineration of particulates on a filter in a manner similar to that previously described hereinabove with reference to the system of FIG. 1.

Referring now to the control valve 92, this valve is also a four-way valve similar in construction to the control valve 82. As shown, the housing 91 of this valve is also provided with opposed outlets 94 and 95 with flow controlled by a valve member 96 fixed to a pivot shaft 97 journaled in housing 91. As illustrated, an exhaust pipe 98 is connected at its 180° elbow end to the outlet 94, while a conduit 67*a* interconnects the outlet 95 to the interior of the intake manifold 12 of the engine.

In the embodiment shown in FIG. 2, a suitable single actuator, such as vacuum actuator 70*a*, is used to effect pivotable movement of the valve member 86 and 96 of control valves 82 and 92, respectively. The vacuum fittings of this actuator 70*a* are adapted to be selectively connected to either a suitable source of vacuum or to the atmosphere, as controlled by suitable three-way solenoid valves, not shown, actuated by means of an electronic control unit in a known manner.

Also as shown, the cleaner member 50*a* and 50*b* are provided with suitable pressure differential gauges 72*a* and 72*b*, respectively, to provide input signals for the electronic control unit relative to the pressure drop across the respective filters 55*a* and 55*b*.

In the operation of this alternate embodiment cleaner and burner system the exhaust gas entering the valve 82 will be directed to flow through one of the cleaner members 50*a*, 50*b* making the associate filter of that cleaner member the then active filter, while the filter of the other cleaner member will then be inactive. Thus with the valve member 86 positioned as shown in FIG. 2, exhaust is directed to flow through the cleaner member 50*b* and, accordingly, the filter 55*b* would be the active filter while the filter 55*a* in cleaner member 50*a* would then be the inactive filter. Regeneration of the inactive filter 55*a* is accomplished in the same manner as described hereinabove with reference to the regeneration of the filter 55 in the system of FIG. 1.

However it should be noted that by the use of the four-way control valves 82 and 92 in the dual path system of FIG. 2, the secondary passage 88 with a single heater means and the passage 58 associated therewith can be used to supply the necessary heat and to supply additional air to effect the sequential incineration of the particulates from the filters 55*a* and 55*b* in independent separate incineration cycles. Thus with the valve members of these control valves positioned as shown in FIG. 2, valve member 86 is positioned to place secondary passage 88 in flow communication with the inactive filter 55*a*, and the position of valve member 96 permits air to be drawn through this filter to flow to the induction manifold 12.

While the invention has been described with reference to the particular embodiments disclosed herein, it is not confined to the details set forth since it is apparent that various modifications can be made by those skilled in the art without departing from the scope of the invention. For example, the valve 43 of the system of FIG. 1 could be used in lieu of the valve 82 in the system of FIG. 2 and separate heater means and air supplies could be provided for the cleaner members of this system, if desired.

Also for example, although in the embodiment shown in FIG. 1, two components are used to define the cleaner member 50 and bypass duct 53 providing the alternate exhaust flow paths downstream of the first valve member 43, it will be apparent that these components could be combined into a single housing means that would be appropriately partitioned so as to define these separate exhaust flow paths therethrough.

This application is therefore intended to cover such modifications or changes as may come within the purposes of the invention as defined by the following claims.

The embodiments of the invention in which an exclusive property or privilege is claimed are defined as follows:

1. An exhaust cleaner and burner system for use with a diesel engine having a throttle controlled induction system maintaining a substantial constant depression in the intake manifold of the engine; said system including an exhaust passage for receiving exhaust gas from the engine; first and second passage means each having an inlet end and an outlet end, a first valve means operatively connected to said exhaust passage and to said inlet ends of said first and second passage means for controlling flow from said exhaust passage selectively to said first and second passage means, a filter positioned in at least said first passage means intermediate the inlet end and outlet end thereof; a heater means and an air inlet passage for the inlet of secondary air at atmospheric pressure operatively associated with at least said first passage means at the inlet end thereof; and, a second valve means operatively associated with said first and second passage means at the outlet ends thereof and with the intake manifold which is operative to control flow from at least said first passage means to the intake manifold whereby manifold vacuum can be used to draw atmospheric air through said air inlet passage, with the air heated by said heater means to effect incineration of particulates trapped on said filter.

2. An exhaust cleaner and burner system for use with a diesel engine having an induction passage with a constant depression throttle means associated therewith and an intake manifold for the induction of air to the engine and, an exhaust duct for carrying off spent combustion products exhausted from the engine; said system including a valve means having an exhaust inlet for receiving exhaust from the exhaust duct and having first and second outlets; first and second exhaust passage means each having an inlet end and an outlet end, with said inlet ends in flow communication with said first and second outlets, respectively, said valve means being operative for the selective control of flow from said exhaust inlet to said inlet ends of said first and second exhaust passage means; at least a first filter operatively supported within said first exhaust passage means intermediate the ends thereof; a heater means and an air inlet passage means for the inlet of secondary air at atmospheric pressure operatively associated with at least the inlet end of said first exhaust passage means; and, a second valve means operatively connected to said outlet ends of said first and second exhaust passage means, said second valve means further including an outlet operatively connectable to the intake manifold of the diesel engine whereby as a result of engine vacuum, secondary air can be drawn through said air inlet passage to support combustion of particulates trapped on said first filter.

3. A particulate cleaner and burner system for a diesel engine having a constant depression control valve means controlling induction flow into an engine intake manifold and having an exhaust passage therefrom for the discharge of spent combustion products exhausted from the engine; said system including a four-way valve means having opposed first and second inlets and opposed first and second outlets and a movable valve therein for the selective control of flow from said first and second inlets to said first and second outlets, said first inlet being connectable to the exhaust passage; a secondary passage means connected to said second inlet; first and second housing means each having a gas inlet connected to said first and second outlets respectively, and each having a gas outlet therefrom; first and second particulate trapping filter means of combustion resistent material operatively positioned in said first and second housing means, respectively; an air inlet means and a heating means operatively associated with said secondary passage means for effecting the incineration of particulates collected on a said filter means during operation of the engine; and, a second valve means having inlets operatively connected to the gas outlets of said housing means and a first outlet for discharge of exhaust to the atmosphere and a second outlet operatively connectable to the engine intake manifold whereby engine vacuum can be used to selectively draw secondary air from said air inlet means through a said filter means for the combustion of particulates thereon.

4. An exhaust cleaner and burner system for use with a diesel engine having a constant depression throttle controlled induction passage for the induction of air to an intake manifold and, an exhaust duct for carrying off spent combustion products exhausted from the engine; said system including means defining separate first and second exhaust passage means and each having an inlet end and an outlet end; a combustion resistant filter operatively supported within said first exhaust passage means intermediate the ends thereof; a fuel burner means including a valve controlled inlet for atmospheric air, connected in flow communication with said first exhaust passage means at said inlet end thereof; a first valve means operatively positioned for the selective control of flow from the exhaust duct to said inlet ends of said first and second exhaust passage means; and, a second valve means having an inlet connected to the outlet end of said first exhaust passage means, a first outlet connected to said second exhaust passage means intermediate the ends thereof and a second outlet connectable to the intake manifold of the engine, said second valve means being operable for the selective control of flow from said first exhaust passage means to said second exhaust passage means and from said first exhaust passage means to the intake manifold.

* * * * *